US009657504B2

(12) United States Patent
Ramsauer

(10) Patent No.: US 9,657,504 B2
(45) Date of Patent: May 23, 2017

(54) HINGE PIN FOR A HINGE OR JOINT

(71) Applicant: Dieter Ramsauer, Schwelm (DE)

(72) Inventor: Dieter Ramsauer, Schwelm (DE)

( * ) Notice: Subject to any disclaimer, the term of this patent is extended or adjusted under 35 U.S.C. 154(b) by 0 days.

(21) Appl. No.: 14/779,593

(22) PCT Filed: Mar. 12, 2014

(86) PCT No.: PCT/EP2014/000651
§ 371 (c)(1),
(2) Date: Sep. 24, 2015

(87) PCT Pub. No.: WO2014/154329
PCT Pub. Date: Oct. 2, 2014

(65) Prior Publication Data

US 2016/0047150 A1 Feb. 18, 2016

(30) Foreign Application Priority Data

Mar. 25, 2013 (DE) ..... 20 2013 002 821 U

(51) Int. Cl.
*E05D 5/10* (2006.01)
*E05D 5/12* (2006.01)
*E05D 3/02* (2006.01)

(52) U.S. Cl.
CPC ..... *E05D 5/125* (2013.01); *E05D 3/02* (2013.01); *E05D 5/10* (2013.01); *E05D 5/12* (2013.01);
(Continued)

(58) Field of Classification Search
CPC ..... Y10T 16/557; Y10T 16/53607; Y10T 16/53625; E05D 2005/102;
(Continued)

(56) References Cited

U.S. PATENT DOCUMENTS 84,772 A * 12/1868 Shannon ..... E05D 3/802 16/263
1,975,570 A * 10/1934 Edgcumbe ..... A47K 13/12 16/365
(Continued)

FOREIGN PATENT DOCUMENTS

| | | |
|---|---|---|
| DE | 20 33 697 | 1/1972 |
| DE | 10 2011 052 317 | 3/2012 |
| FR | 2580344 | 10/1986 |

OTHER PUBLICATIONS

Main Catalog English C19 "Modular Hardware Systems", Feb. 6, 2012, p. 4-250, by Dirak GmbH, Königsfelder Str. 1, 58256 Ennepetal.

(Continued)

*Primary Examiner* — Chuck Mah
(74) *Attorney, Agent, or Firm* — Haug Partners LLP

(57) ABSTRACT

A pin for a hinge or articulated connection comprising two articulated pieces or hinge leaves having in each instance a receiving space for the pin such as an articulated pin or hinge pin, which receiving space is oriented coaxial to the joint axis or hinge axis, wherein the articulated pin or hinge pin is formed of two parts, and wherein the inner end of the one pin part can be connected to the inner end of the other pin part by means of toothed engagement, hooking engagement or clipping engagement.

13 Claims, 20 Drawing Sheets

(52) U.S. Cl.
CPC .. *E05D 2005/102* (2013.01); *E05D 2005/108* (2013.01); *E05Y 2800/20* (2013.01); *E05Y 2800/205* (2013.01)

(58) Field of Classification Search
CPC ..... E05D 2005/106; E05D 2005/105; E05D 7/1022; B65D 43/165
See application file for complete search history.

(56) References Cited

U.S. PATENT DOCUMENTS 3,013,297 A * 12/1961 Ferry ..... E05D 7/1022 16/263
3,135,013 A * 6/1964 Parsons ..... E05D 5/12 16/259
4,233,878 A * 11/1980 McGauran ..... B21H 3/06 411/510
4,345,848 A * 8/1982 Cheselka ..... G02C 5/2281 16/228
4,847,950 A 7/1989 Coleman
4,864,692 A * 9/1989 Prevot ..... E05D 7/1022 16/380
4,987,639 A * 1/1991 Baiuley ..... B65D 25/2858 16/222
5,291,813 A * 3/1994 Blumenthal ..... B26F 1/36 16/386
6,163,929 A * 12/2000 Bradley ..... E05D 5/127 16/380
2005/0224508 A1* 10/2005 Tajiri ..... B65D 43/165 220/844
2008/0115328 A1* 5/2008 Tomaini ..... E05D 5/10 16/386
2011/0010893 A1* 1/2011 Su ..... H01F 7/0231 16/382

OTHER PUBLICATIONS

International Search Report for PCT/EP2014/000651 dated May 13, 2014.

* cited by examiner

Fig. 1A
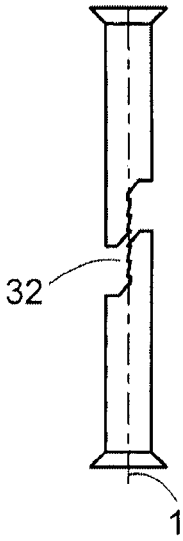
Fig. 1B
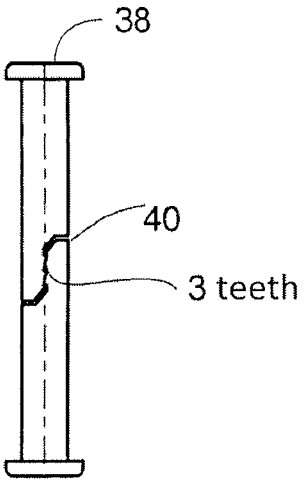
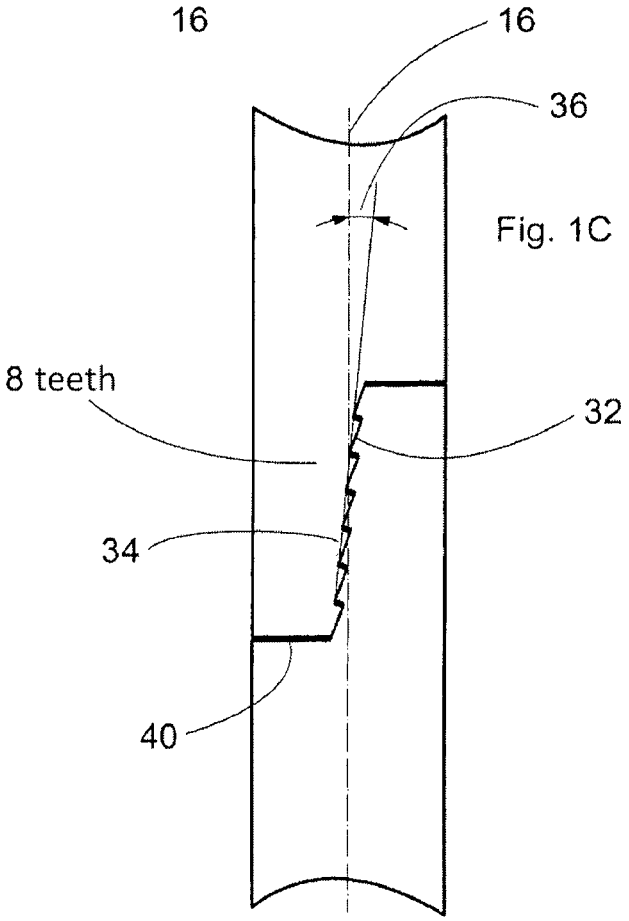
Fig. 1C

Fig. 4B
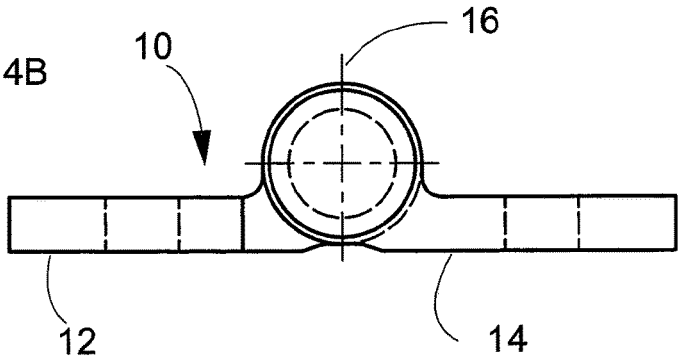
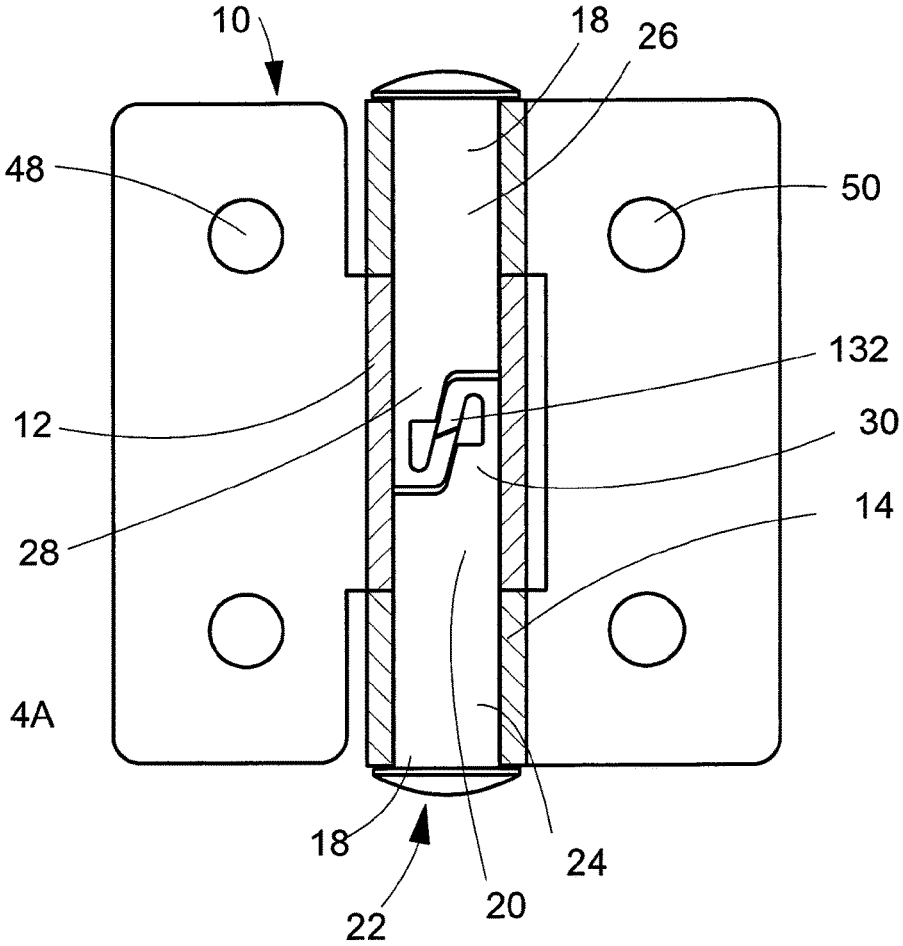
Fig. 4A
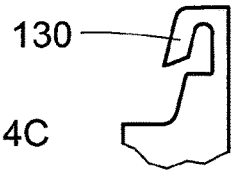
Fig. 4C

Fig. 12A
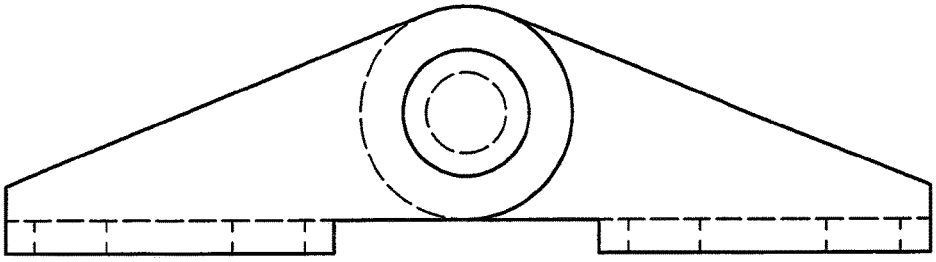
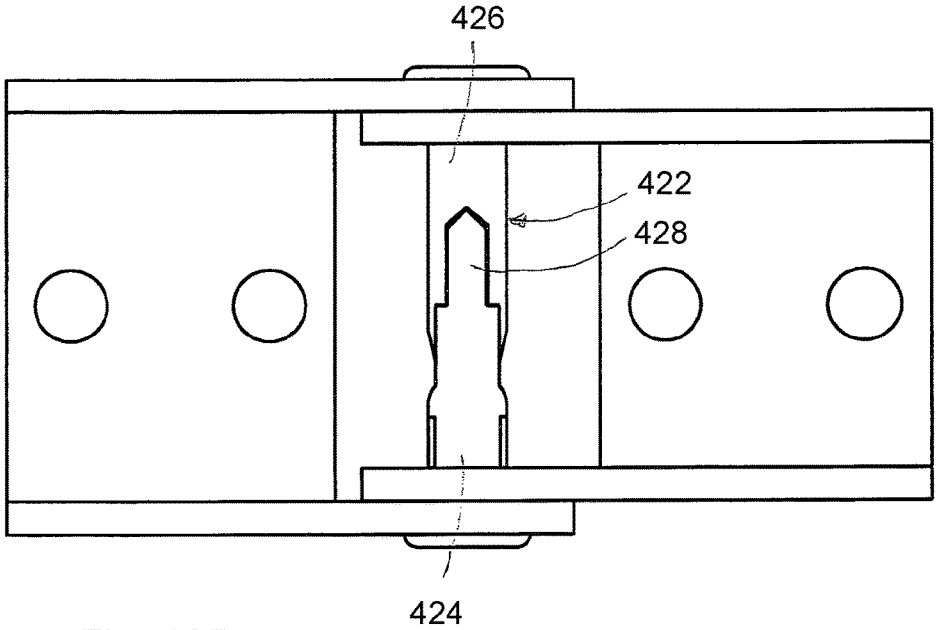
Fig. 12B

Fig. 13A
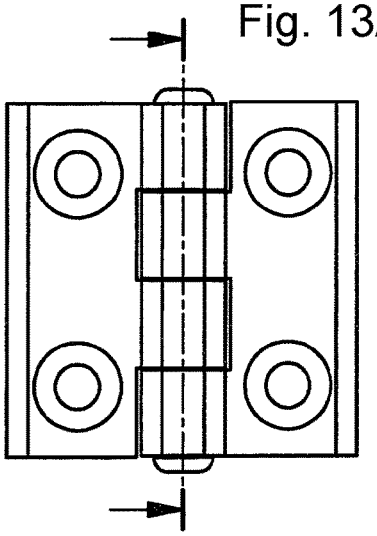
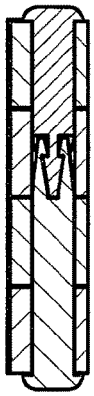
Fig. 13C
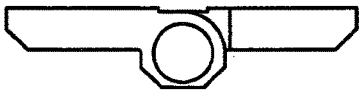
Fig. 13B
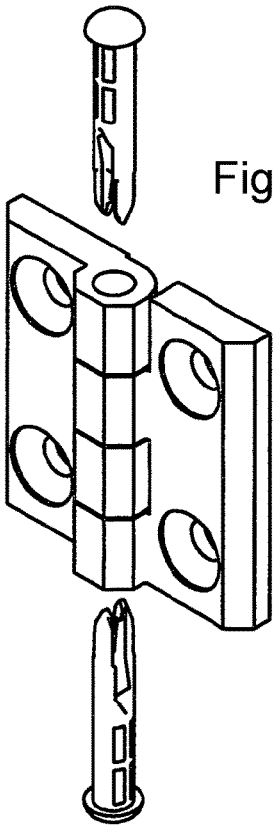
Fig. 13D

HINGE PIN FOR A HINGE OR JOINT

The present application claims priority from PCT Patent Application No. PCT/EP2014/000651 filed on Mar. 12, 2014, which claims priority to German Patent Application No. DE 20 2013 002 821.1 filed on Mar. 25, 2013, the disclosures of which are incorporated herein by reference in their entirety.

FIELD OF THE INVENTION

The invention is directed to a pin for an articulated connection or a hinge comprising two articulated pieces or hinge leaves having in each instance a cylindrical receiving space for a pin such as an articulated pin or hinge pin, which cylindrical receiving space is oriented coaxial to the joint axis or hinge axis, and wherein the articulated pin or hinge pin is formed of two parts.

A (screw-on) hinge which comprises two hinge leaves having in each instance a receiving space oriented coaxial to the hinge axis and a hinge pin is already known from the catalog "Main Catalog C 19", page 4-250, by Dirak GmbH, Königsfelder Str. 1, 58256 Ennepetal. The hinge pin is formed by two separate partial pins which are held by helical compression springs and a screw penetrating the helical compression springs. This is a hinge with a grounding function and is therefore complicated and expensive to produce. On the same catalog page, there is also a hinge with a hinge pin that replaces the two partial pins and is provided with knurling which forms an interference fit in the receiving space. The hinge according to catalog page 4-326 can only be screwed on in disassembled condition. The customer is then responsible for inserting the knurled pin at the device cabinet. The hinge according to catalog page 7-220 can also only be screwed in discrete parts because the screw holes of the bracket are not accessible.

SUMMARY OF THE INVENTION

It is the object of the invention to provide other simpler and more economical embodiment forms of a hinge and hinge pin of the type mentioned above.

The above-stated object is met in that the inner end of the one pin part can be connected to the inner end of the other pin part by means of toothed engagement, hooking engagement or clipping engagement.

Hinge pins of this type serve to connect the two hinge leaves or hinge parts and the parts arranged at the latter to one another in an articulated manner. Mainly, knurled hinge pins which are pressed into the receiving space are employed for this purpose, but this arrangement causes problems. As a result of the knurling, the surface of the bore hole of coated die cast hinges (GdZn) is damaged by the knurling so that corrosion can occur. Further, pressed-in one-piece stainless-steel hinge pins are not perfectly vibration-proof and can be removed for purposes of tampering, for example, to open a cabinet and close it again by installing the hinge pin without it being noticed. Plastic pins have the advantage that in many cases they can be trimmed more easily than metal pins, but plastic pins can also not be fixed securely. A two-part pin is a possibility to be considered. This is true particularly when the two pin parts have the same shape and the same head. The head on both sides makes it clear that tampering is difficult or impossible and that it is vibration-proof.

Two-part pins made of plastic and having tongues which hook together can be installed easily manually, ensure good sliding properties and inhibit corrosion.

Corrosion-inhibiting hinges operate mostly with plastic bushings; then a partial pin is pressed in. However, this is expensive.

In summary, one-part pins have three drawbacks:

1. The pin must be pressed in.
2. The pin can fall out and is therefore not actually vibration-proof.
3. The one-part pin can be tapped out and is therefore not tamper-proof.

A two-part pin with a head or enlargement does not have these disadvantages.

To solve these problems, it is provided that the inner end of the one hinge pin part is connected to the inner end of the other hinge pin part by means of toothed engagement, hooking engagement or clipping engagement. Because it comprises two parts with opposed teeth, the pin can be made to form one part in that its ends are pressed in with these ends being pressed together. This can be carried out by providing a slanted surface with teeth or in that the slanted surface proceeds in each instance from a radially extending surface. It is advantageous when at least the outer end of the at least one hinge pin part forms a radially protruding collar, enlargement, round head or countersunk head.

The toothing can be formed in each instance by two saw teeth which proceed from a lateral surface of a hook. The plastic material with the resilient tongues enables manual assembly without tools.

According to a particular embodiment form, an individual tooth is formed in each instance by the hook. This particularly safeguards against vibration.

The pin in this instance has a head which forms a shoulder. The shoulder of the pin is supported against the central part of the hinge, which part is not accessible. The inaccessibility is made possible in that the head springs back and is supported on the central part of the hinge, the outer parts of the hinge being swivelably held by the heads of the pin parts.

A bushing can be arranged between the hinge pin and the outer hinge part. By inserting through, there results in the center of the hinge a free space into which (and out of which) the hooks may move. A disadvantage would be that the ends of the pin are not guided radially; therefore, it is advisable to choose a construction in which radial displacement is inherently prohibited.

This can be achieved in that the one inner end of the one hinge pin half forms a prism-shaped projection which can be received by a suitably shaped recess in the inner end of the other hinge pin half. This serves to prevent the hinge pin halves from rotating relative to one another in order to secure the hook connection. The hinge pin parts can be correspondingly inversely configured so as to be offset by 90°.

It may be advantageous to configure the hooks such that they narrow toward the end in order to provide space for deflecting during assembly.

It may be advantageous for the head to be shaped as a square so that the pin or pins reliably find the correct position when the square head is displaced.

The description also addresses a hinge or joint with a two-part pin which is characterized in that the hinge pins in assembled condition form a receiving space for a leaf spring which is bent in a V-shape and which is supported at end walls of the receiving space, which walls extend transverse to the pin axis, the free ends being supported on one side and the bend area of the V-shape being supported on the other side.

BRIEF DESCRIPTION OF THE DRAWINGS

The invention will be described more fully in the following with reference to embodiment examples which are illustrated in the drawings.

The drawings show:

FIG. 1A, 1B, 1C show a two-part pin according to the invention with a toothing at the place of separation with a slanted surface in preassembled position, the preassembled position being shown in an enlarged view in FIG. 1C;

FIGS. 4A, 4B, 4C show a further embodiment form of a hinge with pin according to the invention in a side view, front view and detail view;

FIG. 12A shows yet another embodiment form of the invention in a side view;

FIG. 12B shows a top view;

FIG. 13A shows yet another embodiment form of a hinge pin according to the invention for installation in a hinge;

FIG. 13B shows a side view of the hinge;

FIG. 13C shows an axial section along section line A-A of FIG. 13A;

FIG. 13D shows a perspective arrangement before assembly of the hinge pin halves;

DETAILED DESCRIPTION OF EMBODIMENTS

Figure 2:
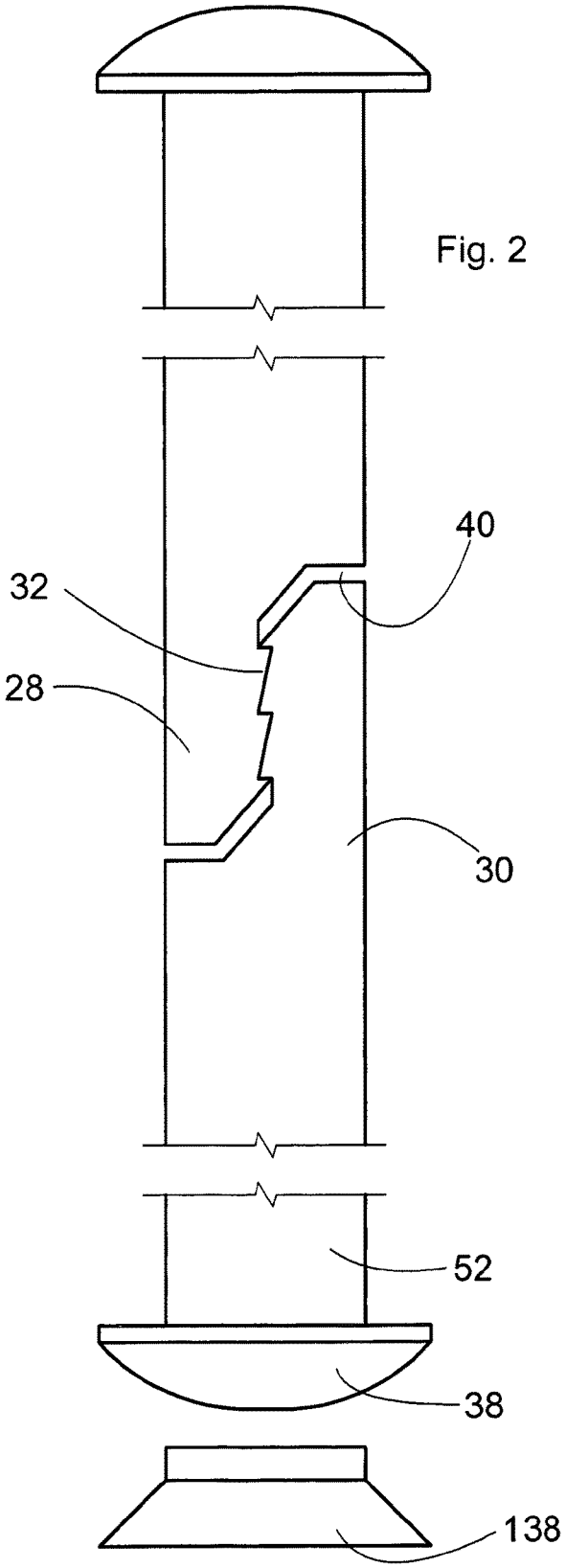
FIG. 2 shows a side view of a two-part hinge pin in combination with a head at both outer ends.

It is to be understood that the figures and descriptions of the present invention have been simplified to illustrate elements that are relevant for a clear understanding of the present invention, while eliminating, for purposes of clarity, many other elements which are conventional in this art. Those of ordinary skill in the art will recognize that other elements are desirable for implementing the present invention. However, because such elements are well known in the art, and because they do not facilitate a better understanding of the present invention, a discussion of such elements is not provided herein.

The present invention will now be described in detail on the basis of exemplary embodiments.

A hinge 10 constructed according to the invention is shown in a top view in FIG. 4A and in a side view in FIG. 4B. The hinge 10 comprises two hinge leaves 12, 14 having in each instance a receiving space 18, 20 for the hinge pin 22, which receiving space 18, 20 is oriented coaxial to the hinge axis 16. These hinge leaves 12, 14 further have bore holes 48, 50, for example, for fastening the hinge leaves 12, 14, e.g., to a door frame or to a door leaf. The hinge pin 22 in this embodiment form according to FIGS. 4A, 4B is also formed of two parts, namely, the two parts 24 and 26. The inner end 28 of the one hinge pin part 26 can be connected to the inner end 30 of the other, second hinge pin part 26 by means of toothed engagement 32 (see FIG. 1A), hooking engagement 132 (see FIGS. 4A, 4B), or by clipping engagement. The toothing, which can comprise three teeth according to FIG. 1A or 1B, but which has eight teeth in FIG. 1C, proceeds from a slanting surface 34 forming an angle 36 with respect to the hinge axis 16. The slanting of the tooth surface 32 of the two hinge pin ends 28, 30 results in a keying of the two ends as is wanted so that they cannot be detached after assembly even as a result of a shaking movement or unauthorized pulling on the ends.

FIG. 1A further shows that at least the outer end 52 of the at least one hinge pin part 24, 26 (see also FIG. 4A) forms a radially protruding enlargement 38, collar, round head, cylindrical head, countersunk head or the like. This provides an additional safeguard against removal by unauthorized persons because the collar 38 prevents the hinge pin 22 from being pushed through and exiting through the hinge space or out of space 18, 20. The slanted surface 34 proceeds from a radially extending surface 40 which forms a stop surface during the assembling movement in axial direction and prevents the parts from moving too far out of the mutually radially aligned position due to the slant.

Figure 3:
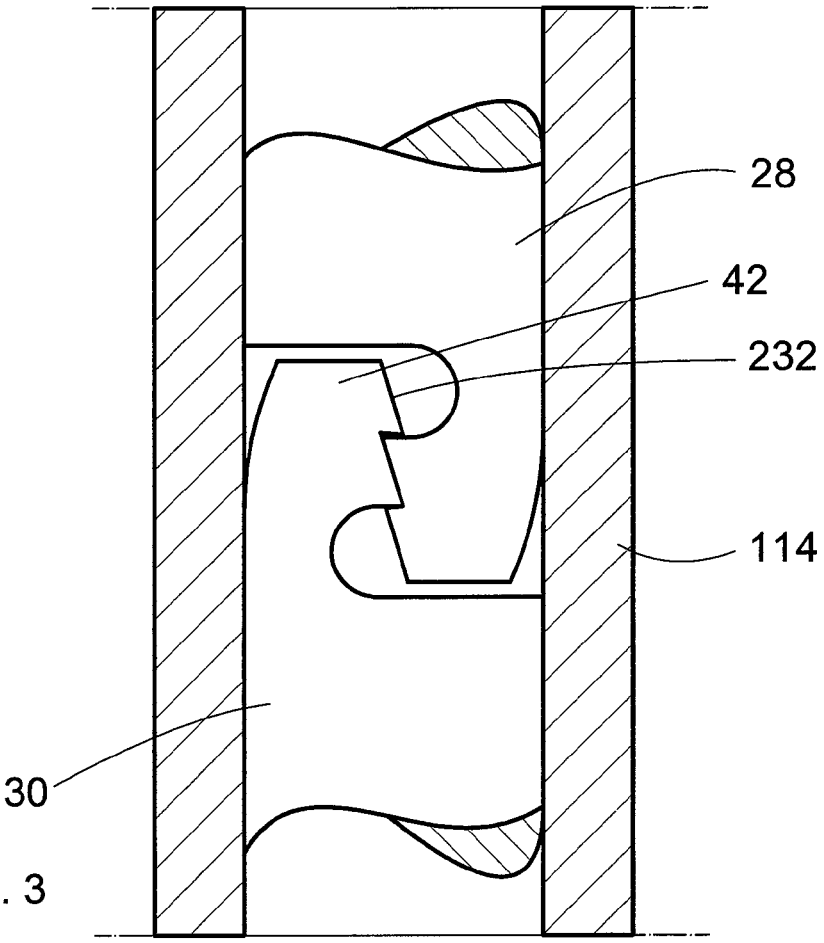
FIG. 3 shows a further embodiment form of a connection area for a two-part pin.

The situation is similar in the embodiment form according to FIG. 2. In the embodiment form according to FIG. 3, the toothing is formed in each instance by two saw teeth 232 which proceed from a lateral surface of a hook 42.

Figure 5A:
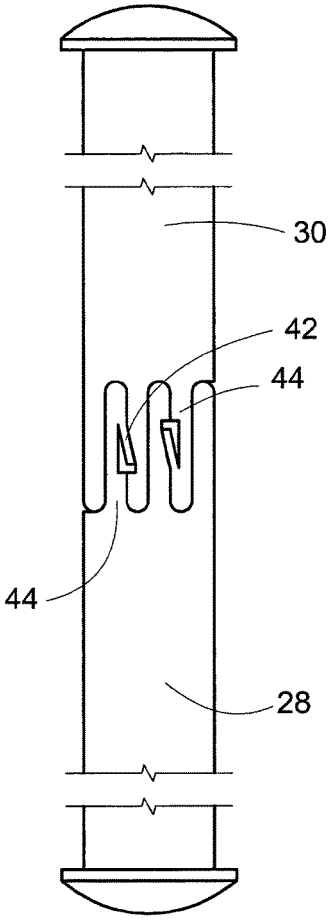
FIG. 5A shows yet another embodiment form of a pin according to the invention.
Figure 5B:
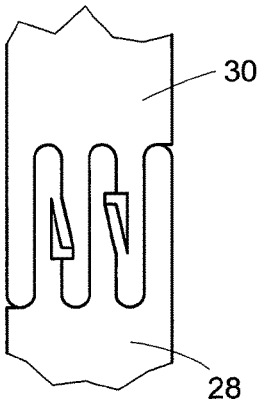
FIG. 5B shows a fragmentary view of further details of the pin according to FIG. 5A.
Figure 6:
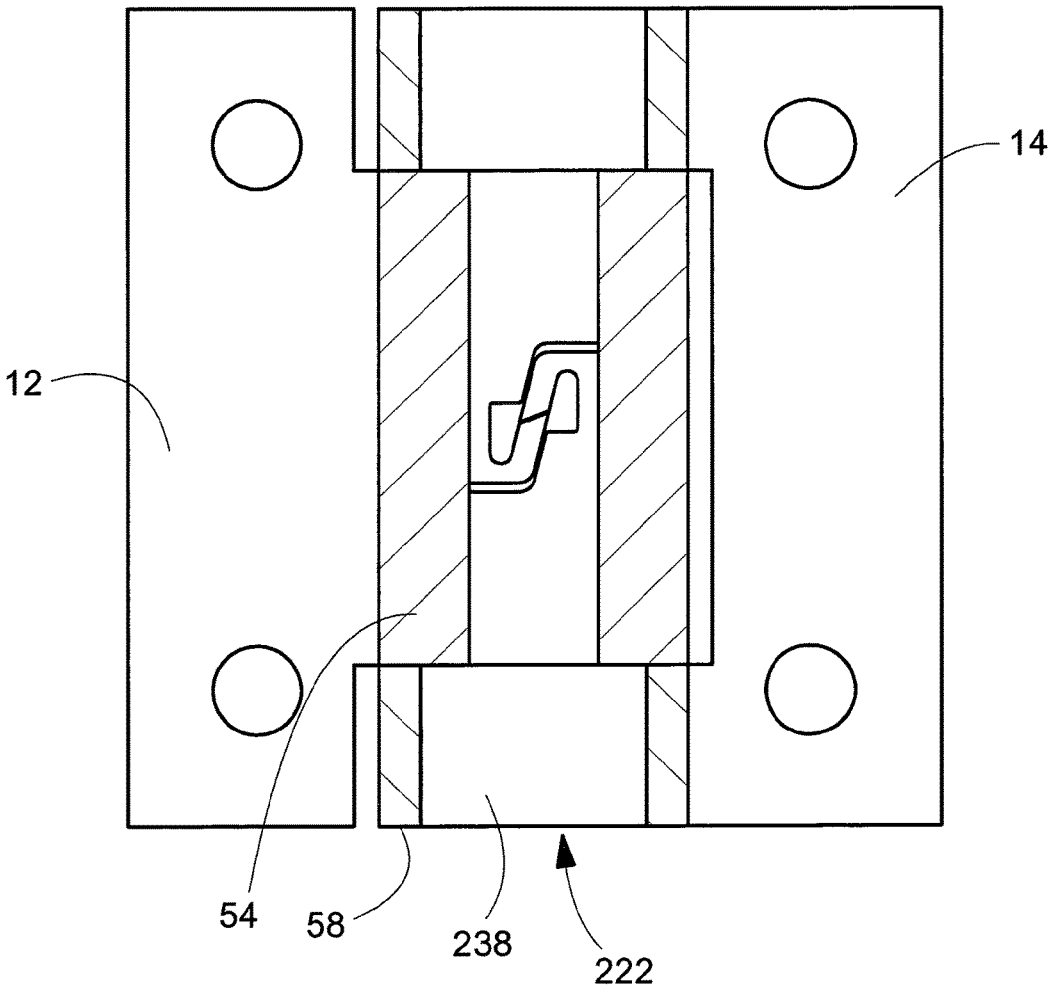
FIG. 6 shows a top view of a further hinge according to the invention.

FIGS. 5A and 5B show that an individual tooth is formed in each instance by hook 42 similar to FIG. 4A. In FIGS. 5A and 5B, the hooks 42 proceed from tongues 44 which are alternately formed by the two inner ends 28, 30 of the hinge pin parts. Referring to FIG. 6, the head 238 retracts and is supported on the central part 54 of the hinge 10, the outer parts 58 of the hinge 10 being held by the heads 238 of the hinge pin 22, 222.

Figure 7:
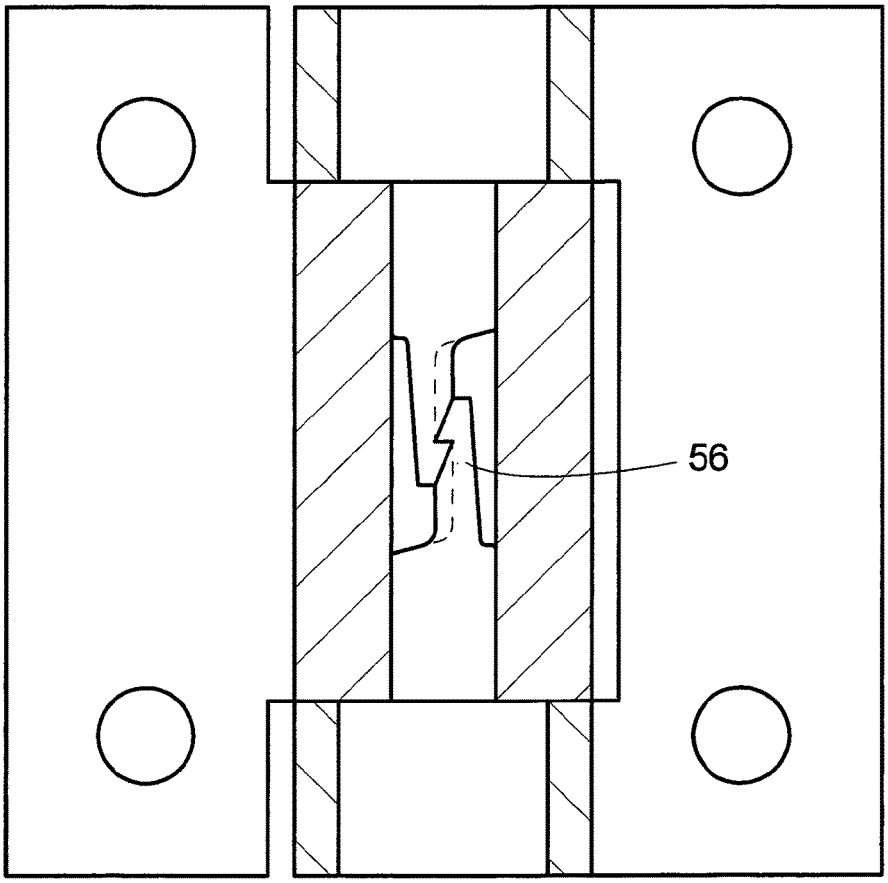
FIG. 7 shows a modified embodiment form of the hinge according to the invention from FIG. 6 in a view similar to that in FIG. 6.

The embodiment form according to FIG. 7 likewise has a protruding head and is accordingly particularly secure against tampering. It differs from the pin according to FIG. 6 in that it works with resilient tips 56 of reduced thickness.

Figure 8A:
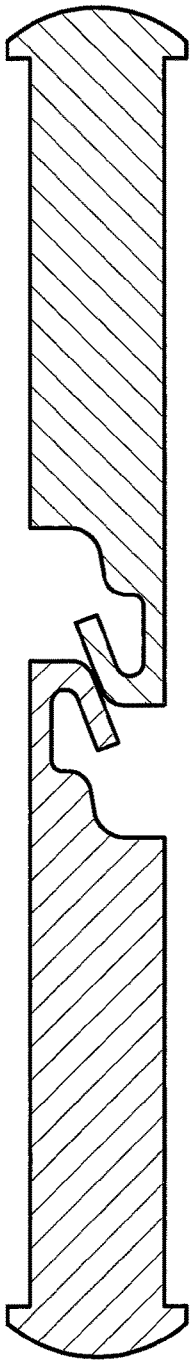
FIGS. 8A, 8B show a pin similar to that shown in FIG. 6 in pre-assembly position and after assembly.
Figure 8B:
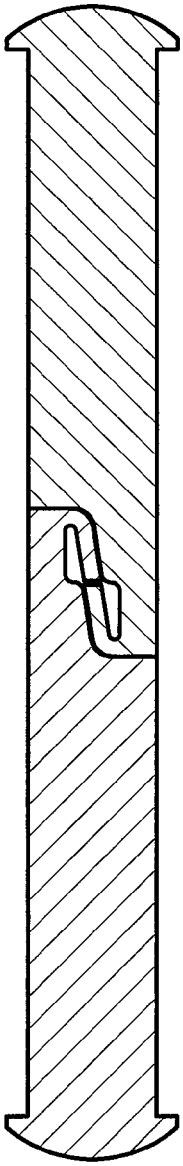
Figure 9A:
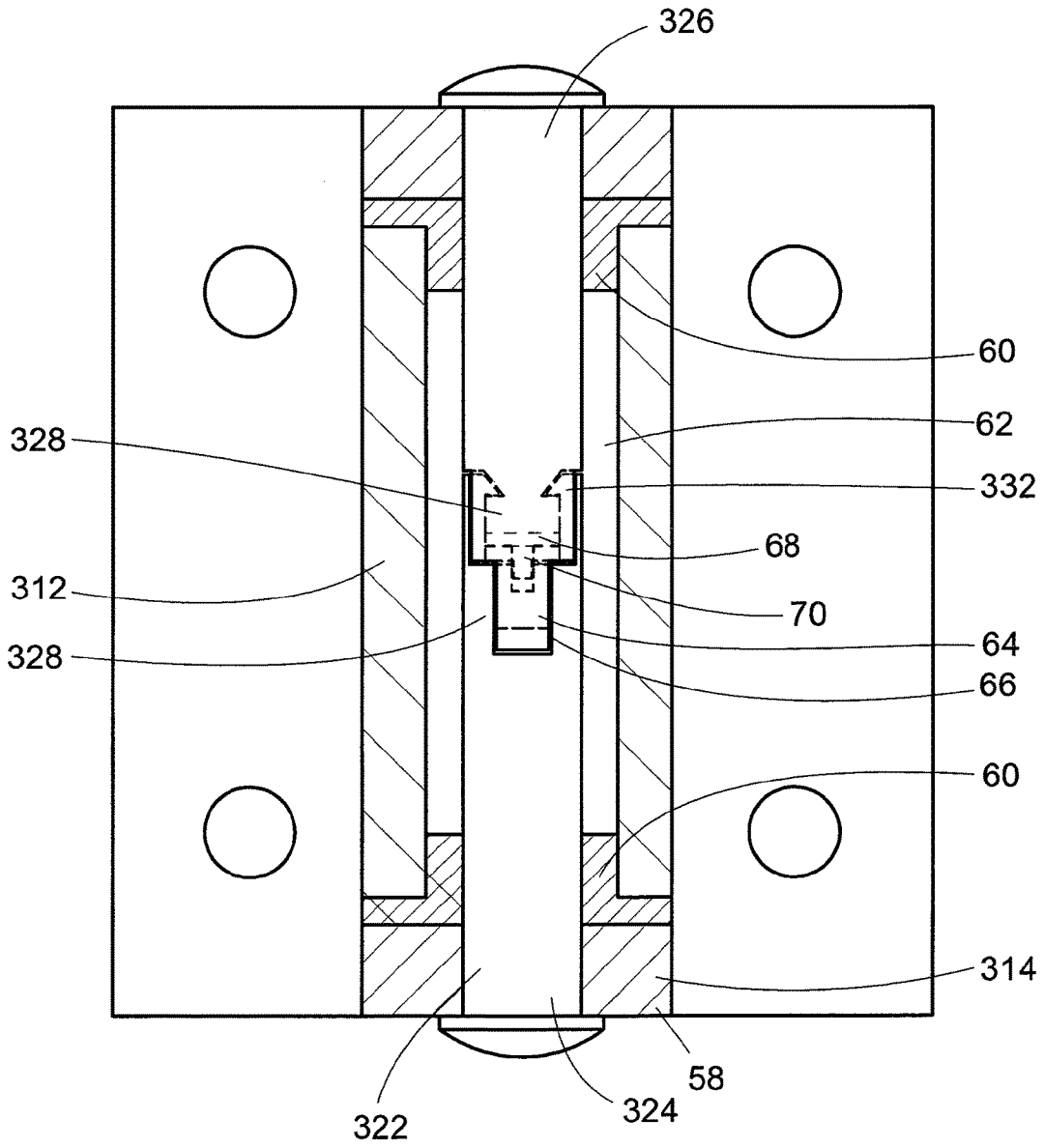
FIG. 9A shows a hinge constructed according to the invention with a sleeve.
Figure 9C:
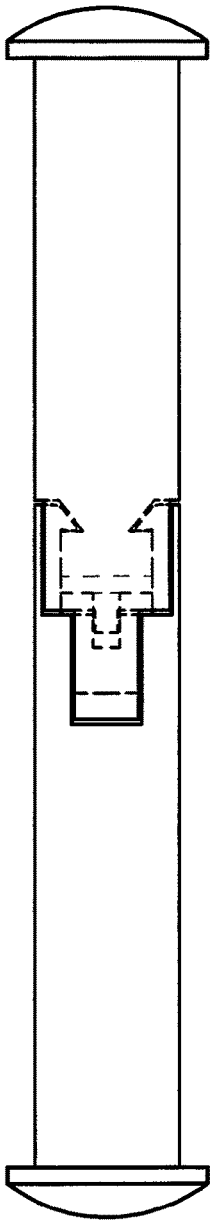
FIG. 9C shows the pin of the hinge from FIG. 9A after joining together.
Figure 9B:
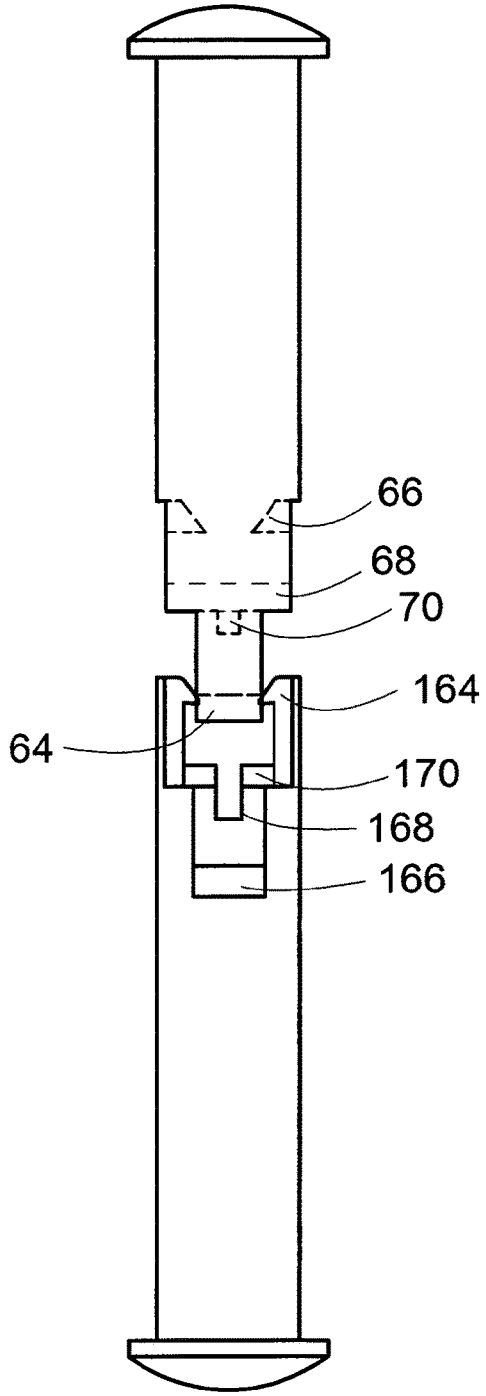
FIG. 9B shows a pin from FIG. 9A before joining together.
Figure 9D:
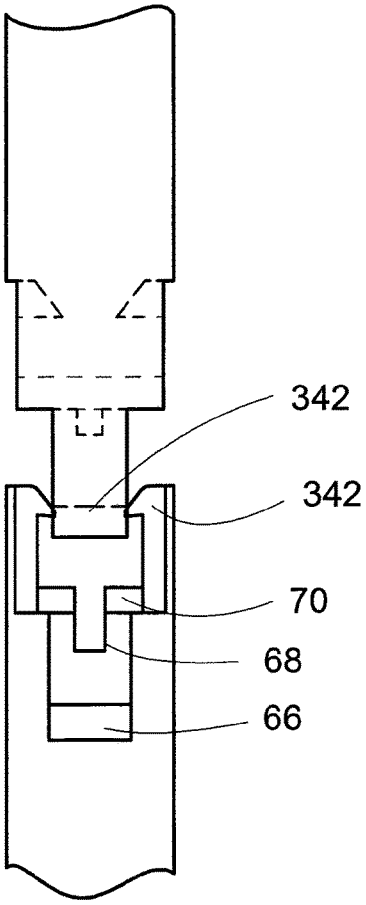
FIG. 9D shows a detailed side view of the central area of the two pin parts before joining together.
Figure 9E:
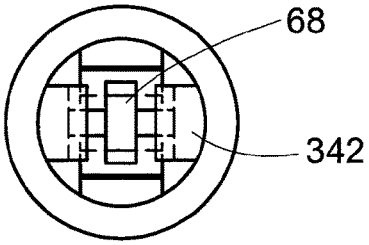
FIG. 9E shows an end view with respect to the one hinge part.
Figure 9F:
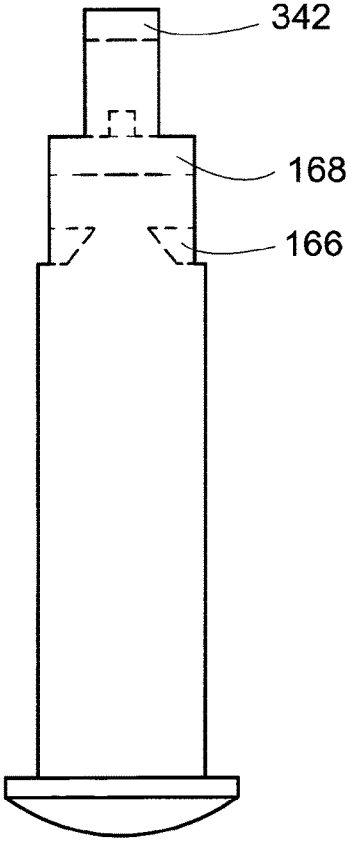
FIG. 9F shows another detail showing the "bottom" portion of the hinge connection rotated 90° with respect to FIG. 9D.

FIG. 8A shows another embodiment form of the hooking engagement. FIG. 8B shows the assembled condition and FIG. 8A shows the condition prior to assembly.

According to the embodiment form of FIGS. 9A to 9F, a sliding bushing 60 is arranged in each instance between the hinge pin 322 and the outer hinge part 58. Accordingly, an area is formed around the connection area of the two-part hinge pin 322 (see reference numeral 62), into which free space the hook 332 can move back during the assembly of the hinge pin, i.e., when the two hinge pin parts 324, 326 are pushed together. It can further be seen that the one inner end 328 of the one hinge pin half 326 forms a hook-shaped projection 64 which can be received by a suitably shaped recess 66 in the inner end 328 of the other hinge pin half 324. This serves to prevent rotation of the hinge pin halves 324, 326 relative to one another and, therefore, to secure the hook connection. Precise guiding is achieved by additional ribs and grooves (see reference numerals 68, 70).

Figure 10D:
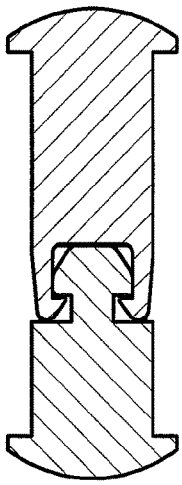
FIG. 10D shows an axial section rotated by 90°.
Figure 10C:
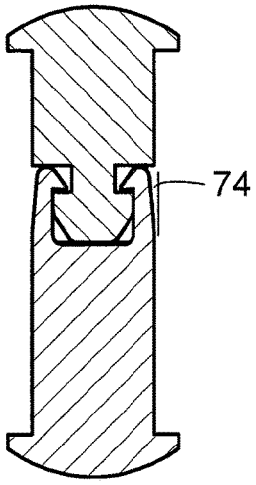
FIG. 10C shows an axial section through the arrangement according to FIG. 10B.
Figure 10A:
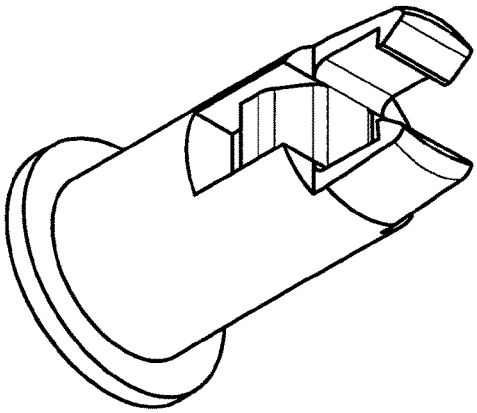
FIG. 10A shows a perspective view of a further embodiment form of a part of the two-part hinge pin.
Figure 10B:
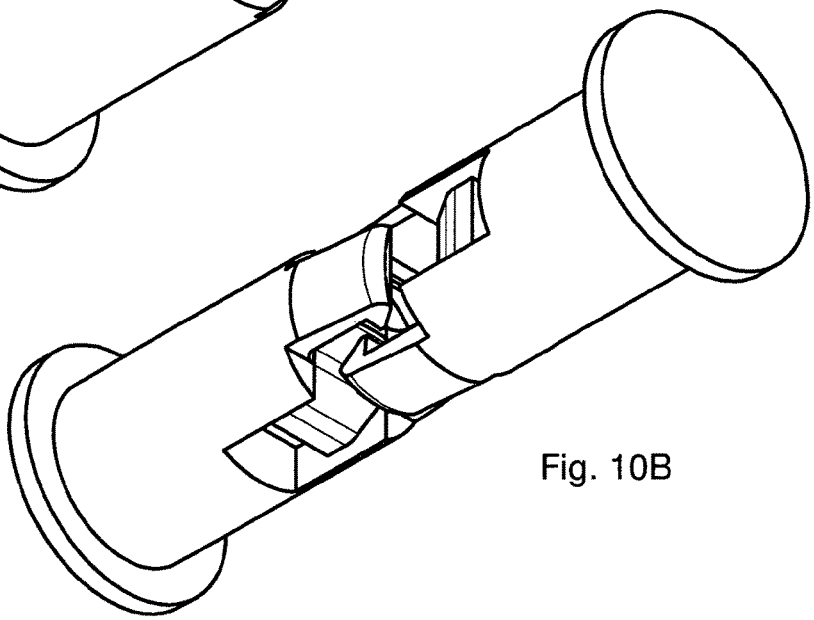
FIG. 10B shows a perspective view of the two parts according to FIG. 10A before assembly.
Figure 10E:
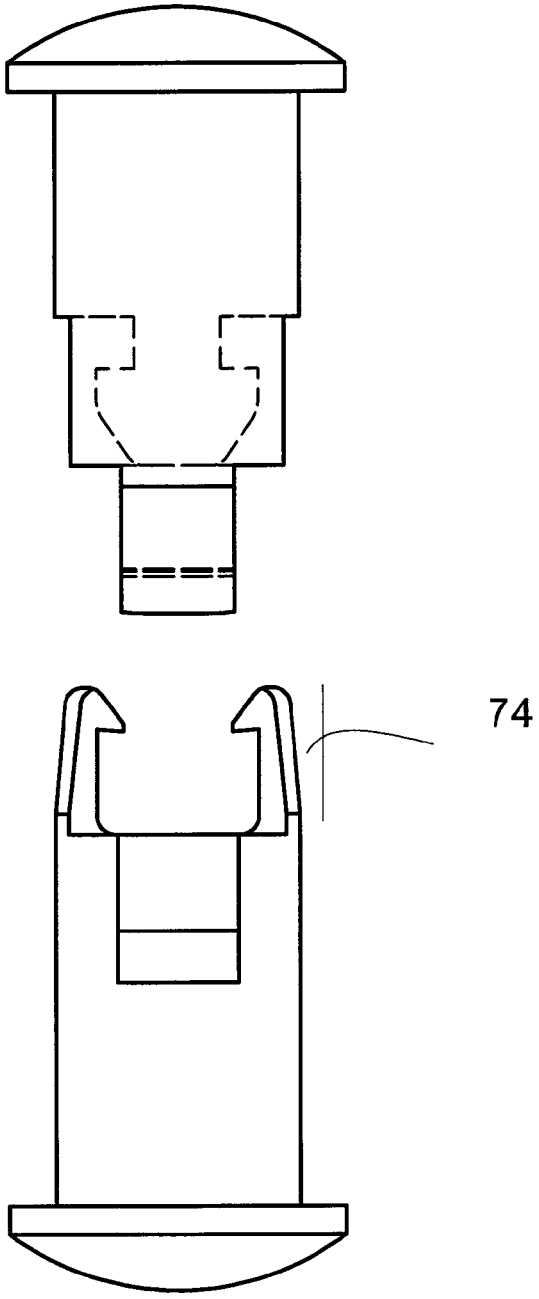
FIG. 10E shows a side view of the embodiment form according to FIGS. 10A and 10B before assembly.

An embodiment form in which two hinge pin halves are again hooked together is shown in a perspective view in FIGS. 10A and 10B, in longitudinal section in FIGS. 10B and 10D and in a side view in FIG. 10F. In this case, the hooks of the one hinge pin part are again arranged so as to be rotated by 90° with respect to the other hinge pin part.

In this case, rotation is prevented in that the hook sides are guided snugly at the recess sides by a kind of claw coupling so that the tongue-and-groove joint is unnecessary in this case.

Figure 11:
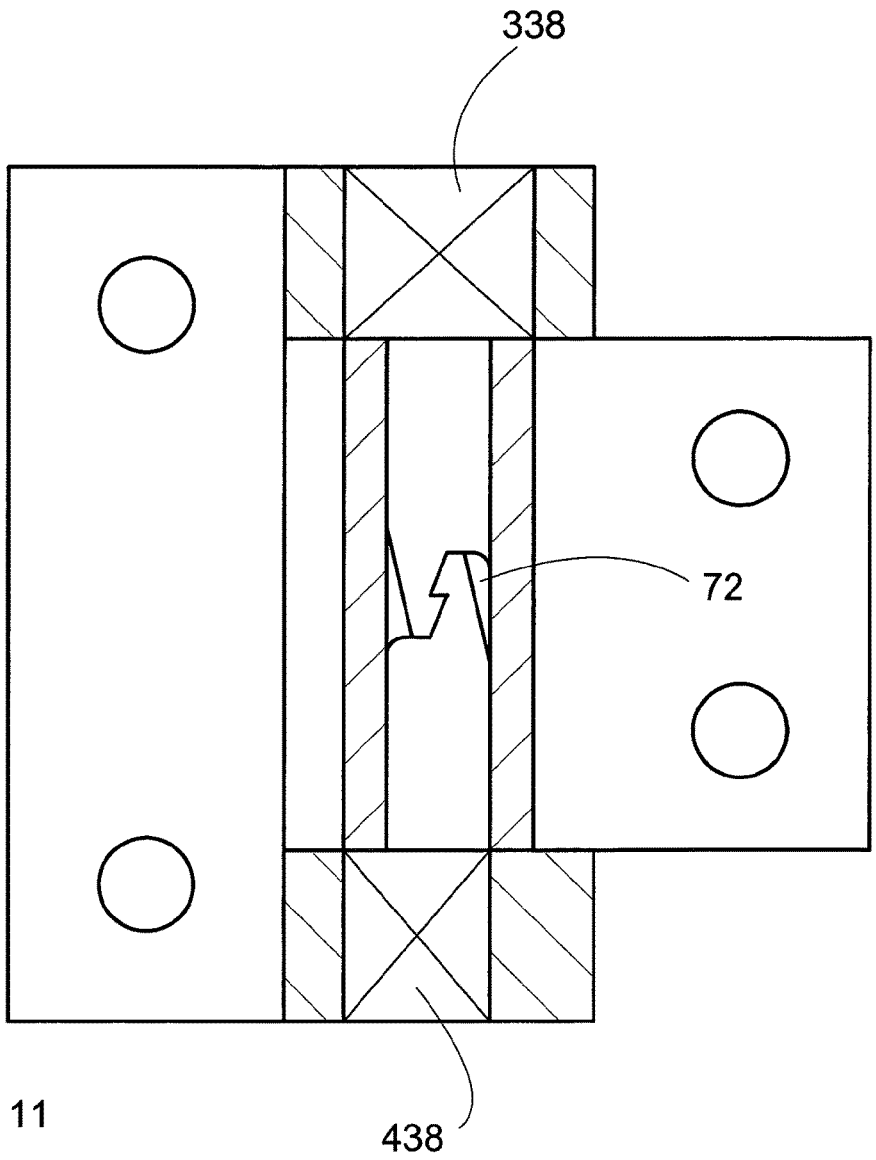
FIG. 11 shows yet another embodiment form of the invention.
Figure 14A:
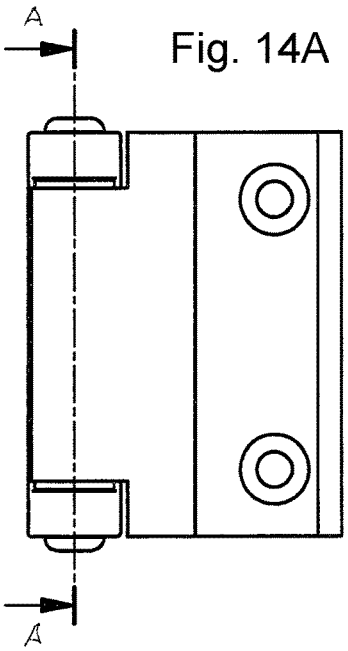
FIGS. 14A to 14D show analogous views of a further embodiment form.
Figure 14B:
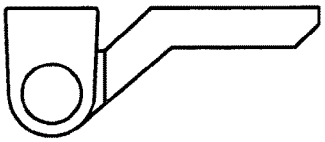
Figure 14C:
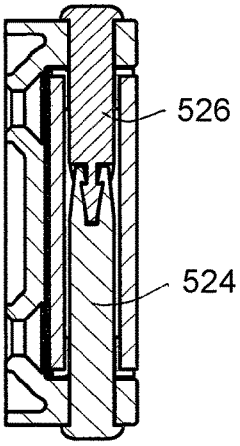
Figure 14D:
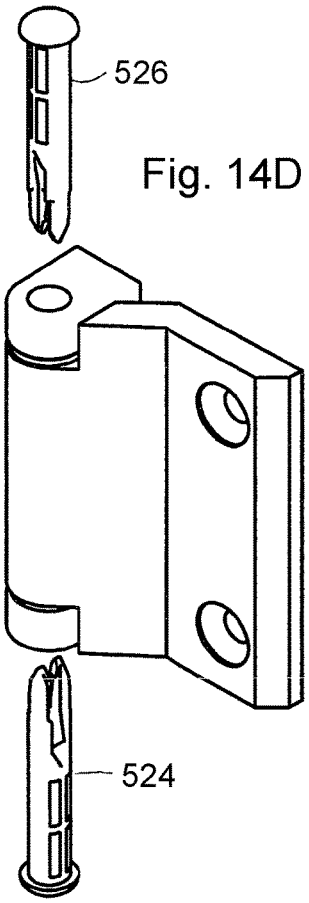

FIG. 11 shows a square head shape 338 which makes possible a flat end face. The square is again put under torsion and rotation of the pin only secures the central part.

When the square 438 is displaced, the pin is (or pins are) securely in the correct rotational position.

Tests have shown that in a steel hinge with a pin diameter of 6 D, where D is approximately 6 mm, the radial height of the tooth base is 3.2 D and the tooth height is accordingly 0.4 D. The hinge bore hole amounts to 6.1 D, the hinge pin parts can be connected to one another in case corresponding pressure is exerted, and the hinge is at the same time easily movable so as to be swivelable around the hinge axis (see the specified measurements in FIG. 2).

Figure 15A:
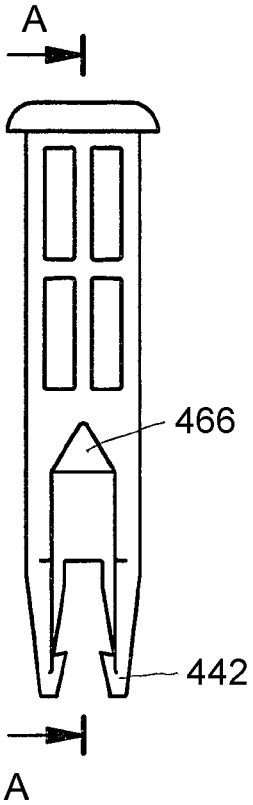
FIG. 15A shows a side view.
Figure 15B:
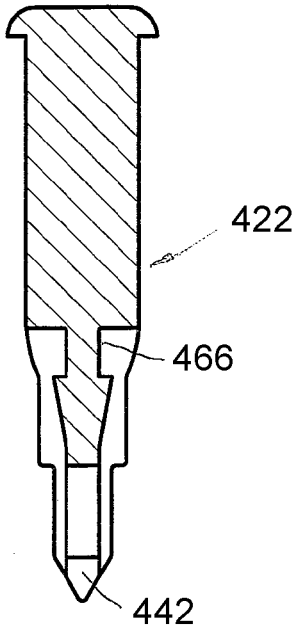
FIG. 15B shows an axial section along section line A-A in FIG. 15A.
Figure 15C:
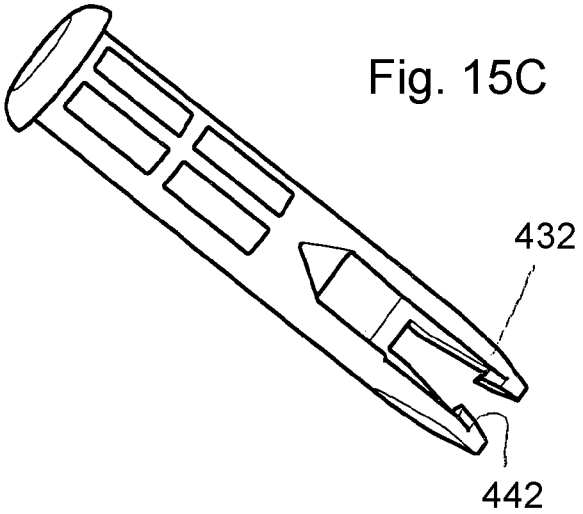
FIG. 15C shows a perspective view of the hinge pin from FIGS. 12, 13 and 14.

The divided hinge pin according to FIGS. 15A to 15C, which is also a kind of claw coupling at the inner ends of the pin parts 424, 426 (FIG. 12B) and 524, 526 (FIG. 14C), respectively, is used in the hinges according to FIGS. 12A to 12D, FIGS. 13A to 13D and FIGS. 14A to 14D.

Figure 16A:
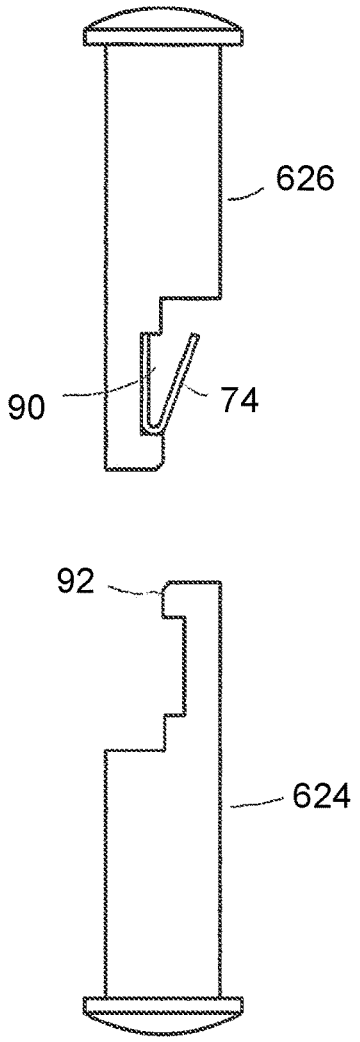
FIG. 16A shows a side view of the two identical halves of an alternative hinge pin with leaf springs in a V-shape for hooking together the hinge pin parts as is shown in FIG. 16B and in an enlarged view in FIG. 16C.
Figure 16B:
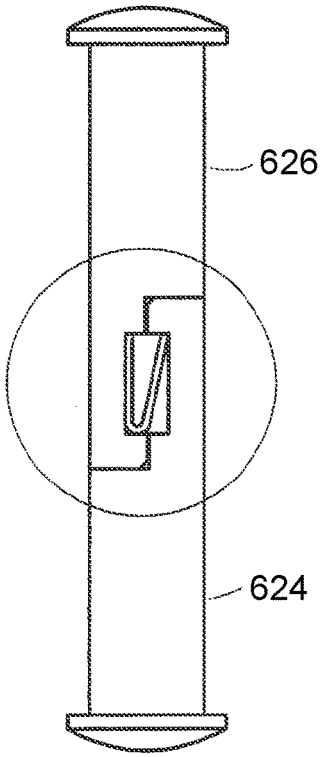
Figure 16C:
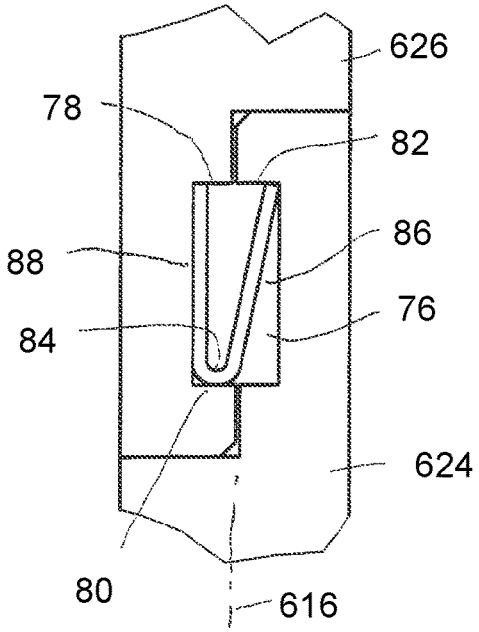

FIG. 16A shows a side view of the two identical halves 624, 626 of an alternative hinge pin with leaf spring 74 in a V-shape for hooking the hinge pin parts to one another as is shown in FIG. 16B and in an enlarged view in FIG. 16C.

After assembly, the hinge pin halves 624, 626 of the pin form a receiving space 76 for a leaf spring 74 which is bent in a V-shaped manner and which is supported at end walls 78, 80 and 82, respectively, (FIG. 16C) of the receiving space 76, which walls extend transverse to the pin axis 616, and the free ends of the V-shape are supported on the one side of walls 78, 80 and the bend area 84 of the V-shape is supported on the other side 80.

The V-shape results in a slanted surface with respect to the pin axis 616 which, during assembly (inserting the two pin parts 624 and 626 together in the hinge bore hole or joint bore hole), is pressed back into space 90 by nose 92 until the leg of the V-shape forming the slanted surface is released and abuts in the corner of the cavity so as to support the pin part 624.

It may be advisable to fix a spring leg in the receiving space, e.g., by gluing the spring leg 88 to the base of the receiving space 76.

COMMERCIAL APPLICABILITY

The invention is commercially applicable in switch cabinet construction.

While this invention has been described in conjunction with the specific embodiments outlined above, it is evident that many alternatives, modifications, and variations will be apparent to those skilled in the art. Accordingly, the preferred embodiments of the invention as set forth above are intended to be illustrative, not limiting. Various changes may be made without departing from the spirit and scope of the inventions as defined in the following claims

LIST OF REFERENCE NUMERALS

10 hinge
12, 312 hinge leaves, central hinge part
14, 314 hinge leaves, outer hinge part
16 hinge axis
18 receiving space
20 receiving space
22, 222, 322 hinge pin
24, 324, 424
524, 624 hinge pin part
26, 326, 426
526, 626 hinge pin part
28, 328 inner end of the one hinge pin part
30 inner end of the other hinge pin part
32, 132, 232,
432 toothing
34 slanted surface
36 angle between slanted surface and hinge axis
38, 138, 238,
338, 438 enlargement, collar, round head, countersunk head, cylindrical head, square head
40 radial surface
42, 342, 442 hook
44 tongue
46 free space
48 opening
50 opening
52 outer end
54 central part
56 central part of reduced thickness
58 outer part
60 bushing
62 space
64 hook-shaped projection
66, 466 recess
68, 168 groove
70, 170 rib
72 narrowing
74 leaf spring
76 receiving space
78 end wall
80 end wall
82 end wall
84 bend area
86 slanted surface
88 spring leg
90 space
92 nose No new matter has been added by the above amendments.

The invention claimed is:

1. An articulated connection or hinge comprising:

a pin; and two articulated pieces or hinge leaves, each having a cylindrical receiving space for the pin;

wherein the cylindrical receiving space is oriented coaxial to a connection axis or hinge axis of the articulated connection or hinge;

wherein the pin comprises:

a first pin part; and a second pin part;

wherein an end of the first pin part comprises a first hook, and an end of the second pin part comprises a second hook;

wherein an inner end of the first hook comprises a first toothing and an inner end of the second hook comprises a second toothing configured to engage with the first toothing to connect the first pin part to the second pin part;

wherein the first toothing and the second toothing each comprises one to eight teeth;

wherein the first pin part and the second pin part each comprise a head that is configured to sit inside a respective outer part of the articulated connection or hinge in an axial direction of the connection axis or hinge axis;

wherein each head forms a shoulder that is supported on a central part of the articulated connection or hinge, the central part being located between the outer parts in the axial direction; and wherein the outer parts of the articulated connection or hinge are swivelably held by the heads of the first and second pin parts.

2. The articulated connection or hinge according to claim 1;

wherein the shoulder of each head is supported on the central part indirectly via a bushing that is arranged between the pin and the central part, the bushing forming a space for the two-part pin around a connection area;

wherein the space formed by the bushing around the connection area of the two-part hinge pin is configured to accommodate the first hook and allow the first hook to move back during assembly of the hinge pin.

3. The articulated connection or hinge according to claim 1;

wherein the first and second hooks narrow toward their respective ends and accordingly provide maneuvering space for assembly.

4. The articulated connection or hinge according to claim 1;

wherein the head is square.

5. An articulated connection or hinge comprising:

a pin; and two articulated pieces or hinge leaves, each having a cylindrical receiving space for the pin;

wherein the cylindrical receiving space is oriented coaxial to a connection axis or hinge axis of the articulated connection or hinge;

wherein the pin comprises:

a first pin part; and a second pin part;

wherein an inner end of the one of the first and second pin parts forms a hook-shaped projection configured to be received by a suitably shaped recess in the inner end of the other of the first and second pin parts to prevent the two pin parts from rotating relative to one another and to secure the connection between the two pin parts; and wherein the first and second pin parts are identical, and are configured to be connected to each other with the first pin part being inverted and rotated by 90° with respect to the second pin part.

6. The articulated connection or hinge according to claim 5;

wherein the first pin part and the second pin part each comprise a head that is configured to sit inside a respective outer part of the articulated connection or hinge in an axial direction of the connection axis or hinge axis;

wherein each head forms a shoulder that is supported on a central part of the articulated connection or hinge, the central part being located between the outer parts in the axial direction; and wherein the outer parts of the articulated connection or hinge are swivelably held by the heads of the first and second pin parts.

7. The articulated connection or hinge according to claim 6;

wherein the head is square.

8. The articulated connection or hinge according to claim 5;

wherein a bushing is arranged between the pin and the central part, the bushing forming a space for the two-part pin around a connection area;

wherein the space formed by the bushing around the connection area of the two-part hinge pin is configured to accommodate the hook-shaped projection and allow the hook-shaped projection to move back during assembly of the hinge pin.

9. An articulated connection or hinge comprising:

a pin; and two articulated pieces or hinge leaves, each having a cylindrical receiving space for the pin;

wherein the cylindrical receiving space is oriented coaxial to a connection axis or hinge axis of the articulated connection or hinge;

wherein the pin comprises:

a first pin part; and a second pin part;

wherein an end of the first pin part comprises a first hook, and an end of the second pin part comprises a second hook;

wherein the first pin part and the second pin part each comprise a head that is configured to sit inside a respective outer part of the articulated connection or hinge in an axial direction of the connection axis or hinge axis;

wherein each head forms a shoulder that is supported on a central part of the articulated connection or hinge, the central part being located between the outer parts in the axial direction; and wherein the outer parts of the articulated connection or hinge are swivelably held by the heads of the first and second pin parts, wherein the first hook and the second hook are configured to engage with each other via a leaf spring that is bent in a V-shape;

wherein, after assembly, the two pin parts form a receiving space for the leaf spring, which is supported as part of the pin at end walls of the receiving space;

wherein the end walls extend transverse to a pin axis; and wherein free ends of the V-shape are supported on one of the end walls and a bend area of the V-shape is supported on another of the end walls.

10. An articulated connection or hinge comprising:

a pin;

two articulated pieces or hinge leaves, each having a cylindrical receiving space for the pin;

wherein the cylindrical receiving space is oriented coaxial to a connection axis or hinge axis of the articulated connection or hinge;

wherein the pin comprises:

a first pin part; and a second pin part;

wherein an end of the first pin part comprises a first hook, and an end of the second pin part comprises a second hook;

wherein an inner end of the first hook comprises a first toothing and an inner end of the second hook comprises a second toothing configured to engage with the first toothing to connect the first pin part to the second pin part;

wherein the first toothing and the second toothing each comprises one to eight teeth;

wherein:

a pin diameter is 6 D, where D is approximately 6 mm;

a radial height of a tooth base is 3.2 D and the tooth height is 0.4 D; and a diameter of at least a portion of one of the cylindrical receiving spaces is 6.1 D; and wherein the first and second pin parts are configured to be connected to one another when a corresponding pressure is exerted, and to simultaneously be easily movable so as to be swivelable around the connection axis or hinge axis.

11. The articulated connection or hinge according to claim 10;

wherein the first pin part and the second pin part each comprise a head that is configured to sit inside a respective outer part of the articulated connection or hinge in an axial direction of the connection axis or hinge axis;

wherein each head forms a shoulder that is supported on a central part of the articulated connection or hinge, the central part being located between the outer parts in the axial direction; and wherein the outer parts of the articulated connection or hinge are swivelably held by the heads of the first and second pin parts.

12. The articulated connection or hinge according to claim 11;

wherein the head is square.

13. The articulated connection or hinge according to claim 10;

wherein a bushing is arranged between the pin and the central part, the bushing forming a space for the two-part pin around a connection area;

wherein the space formed by the bushing around the connection area of the two-part hinge pin is configured to accommodate the first hook so that the first hook may move back during assembly of the hinge pin.

* * * * *